US010032588B2

(12) United States Patent
Gonzales et al.

(10) Patent No.: US 10,032,588 B2
(45) Date of Patent: Jul. 24, 2018

(54) INTEGRATED HIGH VOLTAGE CONTACTOR AND SERVICE DISCONNECT

(71) Applicant: Ford Global Technologies, LLC, Dearborn, MI (US)

(72) Inventors: Philip Michael Gonzales, Dearborn, MI (US); Ray C. Siciak, Ann Arbor, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 769 days.

(21) Appl. No.: 14/034,941

(22) Filed: Sep. 24, 2013

(65) Prior Publication Data

US 2015/0084724 A1 Mar. 26, 2015

(51) Int. Cl.

| | |
|---|---|
| ***H01H 50/54*** | (2006.01) |
| ***H01H 47/22*** | (2006.01) |
| ***H01H 49/00*** | (2006.01) |
| ***H01H 83/04*** | (2006.01) |
| *H01H 71/04* | (2006.01) |

(52) U.S. Cl.

CPC ..... *H01H 50/541* (2013.01); *H01H 47/22* (2013.01); *H01H 49/00* (2013.01); *H01H 50/54* (2013.01); *H01H 83/04* (2013.01); *H01H 2071/044* (2013.01); *Y10T 29/49117* (2015.01)

(58) Field of Classification Search

CPC ..... H01H 47/22; H01H 50/541; H01H 49/00
USPC ..... 335/126
See application file for complete search history.

(56) References Cited

U.S. PATENT DOCUMENTS

| | | | | |
|---|---|---|---|---|
| 4,578,732 | A * | 3/1986 | Draper et al. | 361/45 |
| 5,099,385 | A * | 3/1992 | Faffart | 361/245 |
| 6,937,123 | B2 * | 8/2005 | Imanishi et al. | 335/126 |
| 6,958,895 | B1 * | 10/2005 | Radosavljevic et al. | 361/42 |
| 8,125,192 | B2 | 2/2012 | Yoon et al. | |
| 8,288,031 | B1 | 10/2012 | Marejek et al. | |
| 2004/0021996 | A1 * | 2/2004 | Wu et al. | 361/42 |
| 2004/0070474 | A1 * | 4/2004 | Wu et al. | 335/18 |
| 2009/0179718 | A1 * | 7/2009 | Aubigny et al. | 335/126 |
| 2010/0075206 | A1 | 3/2010 | Tamura | |
| 2011/0043307 | A1 * | 2/2011 | Gonzales et al. | 335/189 |
| 2011/0079494 | A1 | 4/2011 | Joswig et al. | |
| 2011/0104521 | A1 | 5/2011 | Kishimoto et al. | |
| 2013/0335174 | A1 * | 12/2013 | Kodama et al. | 335/2 |

FOREIGN PATENT DOCUMENTS

| | | | | |
|---|---|---|---|---|
| WO | WO 9428567 | A1 * | 12/1994 | H01H 9/542 |

OTHER PUBLICATIONS

High Voltage Battery and Power Distribution Technology; Authors: Kevin Vickers, Richard Senter, Michael Nicholas; http://www2.warwick.ac.uk/fac/sci/wmg/research/lcvtp/news/hevc11/ws4-review-may11.pdf.

* cited by examiner

*Primary Examiner* — Mohamad Musleh
(74) *Attorney, Agent, or Firm* — Carlson, Gaskey & Olds

(57) ABSTRACT

An integrated contactor/service disconnect assembly according to an exemplary aspect of the present disclosure includes, among other things, a stationary contact, a movable contact selectively movable relative to the stationary contact and a service disconnect unit configured to block the movable contact from contacting the stationary contact.

16 Claims, 4 Drawing Sheets

INTEGRATED HIGH VOLTAGE CONTACTOR AND SERVICE DISCONNECT

TECHNICAL FIELD

This disclosure relates to electrified vehicles, and more particularly, but not exclusively, to an integrated contactor/service disconnect assembly that can be operated as both a standard contactor and a manually operated service disconnect.

BACKGROUND

Hybrid electric vehicles (HEV's), plug-in hybrid electric vehicles (PHEV's), battery electric vehicles (BEV's), fuel cell vehicles and other known electrified vehicles differ from conventional motor vehicles in that they employ one or more electric machines (i.e., electric motors and/or generators) in addition or as an alternative to an internal combustion engine to drive the vehicle. High voltage current is typically supplied by one or more battery assemblies that store and supply electrical power for powering the electric machines.

The battery assemblies employed by an electrified vehicle may include contactors that isolate energy stored in the battery from loads to prevent current overloading. For example, the contactors may act as high voltage relays for switching supply currents communicated to the electric machines. The contactors disconnect the battery assembly from a high voltage bus during normal vehicle operation. A separate service disconnect that is remote from the contactors may also be used to prepare to service high voltage components of the electrified vehicle.

SUMMARY

An integrated contactor/service disconnect assembly according to an exemplary aspect of the present disclosure includes, among other things, a stationary contact, a movable contact selectively movable relative to the stationary contact and a service disconnect unit configured to block the movable contact from contacting the stationary contact.

In a further non-limiting embodiment of the foregoing assembly, the stationary contact is a high voltage pin.

In a further non-limiting embodiment of either of the foregoing assemblies, the movable contact is a busbar carried by a shaft.

In a further non-limiting embodiment of any of the foregoing assemblies, a coil is at least partially wrapped around the shaft.

In a further non-limiting embodiment of any of the foregoing assemblies, the service disconnect unit is moveable between a first position in which the stationary contact and the movable contact may contact one another and a second position in which the stationary contact and the movable contact are prevented from contacting one another.

In a further non-limiting embodiment of any of the foregoing assemblies, the service disconnect unit includes a service button and a prong that extends from the service button.

In a further non-limiting embodiment of any of the foregoing assemblies, the prong is movable to a position between the stationary contact and the movable contact.

In a further non-limiting embodiment of any of the foregoing assemblies, the service disconnect unit is movable in a first direction and the movable contact is movable in a second, different direction.

In a further non-limiting embodiment of any of the foregoing assemblies, a control unit is configured to command movement of the movable contact toward the stationary contact.

In a further non-limiting embodiment of any of the foregoing assemblies, a sensor is configured to sense a current through the stationary contact and a fuse is configured to interrupt the flow of the current.

An energy storage device according to an exemplary aspect of the present disclosure includes, among other things, a contactor and a service disconnect unit integrated with the contactor.

In a further non-limiting embodiment of the foregoing energy storage device, the contactor includes a movable contact and a stationary contact. The service disconnect unit is moveable between a first position and a second position to prevent contact between the movable contact and the stationary contact.

In a further non-limiting embodiment of either of the foregoing energy storage devices, the service disconnect unit includes a service button positioned relative to an exterior wall of a housing of the contactor and a prong that extends inside of the housing.

In a further non-limiting embodiment of any of the foregoing energy storage devices, the prong is movable to a position between two contacts of the contactor to disable high voltage current through the contactor.

In a further non-limiting embodiment of any of the foregoing energy storage devices, a control unit is configured to energize a coil of the contactor.

A vehicle service method according to an exemplary aspect of the present disclosure includes, among other things, engaging a service disconnect unit of an integrated contactor/service disconnect assembly, removing the assembly if the service disconnect unit is not movable between a first position and a second position and disabling a high voltage current if the service disconnect unit moves from the first position to the second position.

In a further non-limiting embodiment of the foregoing method, the method includes pressing a service button of the service disconnect unit.

In a further non-limiting embodiment of either of the foregoing methods, the removing step is performed in response to contacts of a contactor welding together.

In a further non-limiting embodiment of any of the foregoing methods, the disabling step includes positioning a prong of the service disconnect unit between at least two contacts of a contactor.

In a further non-limiting embodiment of any of the foregoing methods, the method includes replacing the assembly with a new integrated contactor/service disconnect assembly after the step of removing.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

The various features and advantages of this disclosure will become apparent to those skilled in the art from the following detailed description. The drawings that accompany the detailed description can be briefly described as follows.

DETAILED DESCRIPTION

This disclosure relates to an integrated contactor/service disconnect assembly for use in an electrified vehicle. The exemplary assembly operates within a single, combined unit as a both standard contactor as well as a manually operated service disconnect. The integrated assembly can be used to isolate a high voltage energy storage device, such as a battery, from a high voltage bus during certain vehicle conditions. Among other features, the integrated contactor/service disconnect assembly of this disclosure reduces weight and costs by integrating components and functionality and improves energy storage device reliability.

Figure 1:
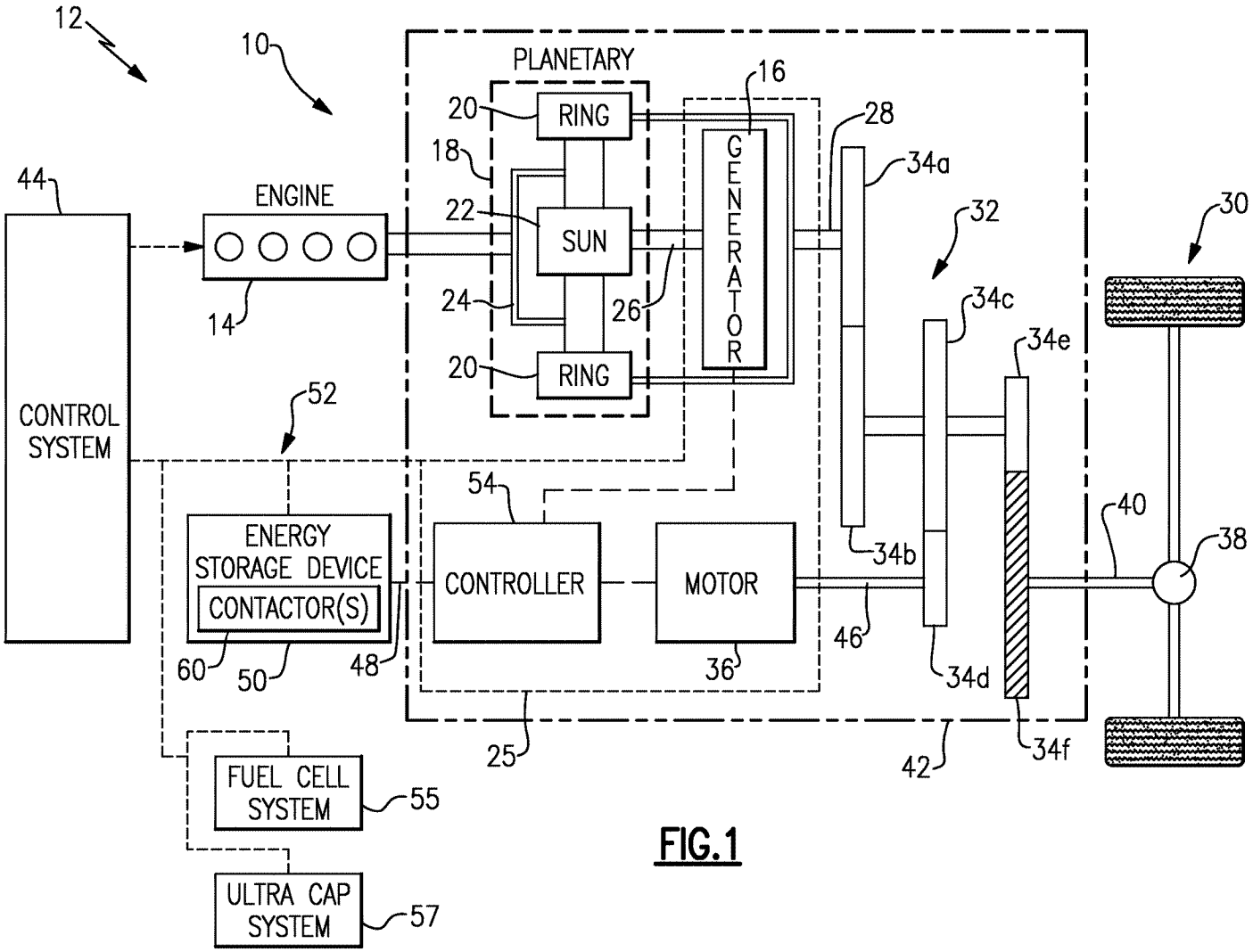
FIG. 1 schematically illustrates a powertrain of an electrified vehicle.

FIG. 1 schematically illustrates a powertrain 10 for an electrified vehicle 12, such as a HEV. Although depicted as a HEV, it should be understood that the concepts described herein are not limited to HEV's and could extend to other electrified vehicles, including but not limited to, PHEV's, BEV's, and fuel cell vehicles.

In one embodiment, the powertrain 10 is a powersplit system that employs a first drive system that includes a combination of an engine 14 and a generator 16 (i.e., a first electric machine) and a second drive system that includes at least a motor 36 (i.e., a second electric machine), the generator 16 and an energy storage device 50. For example, the motor 36, the generator 16 and the energy storage device 50 may make up an electric drive system 25 of the powertrain 10. The first and second drive systems generate torque to drive one or more sets of vehicle drive wheels 30 of the electrified vehicle 12, as discussed in greater detail below.

The engine 14, such as an internal combustion engine, and the generator 16 may be connected through a power transfer unit 18. In one non-limiting embodiment, the power transfer unit 18 is a planetary gear set. Of course, other types of power transfer units, including other gear sets and transmissions, may be used to connect the engine 14 to the generator 16. The power transfer unit 18 may include a ring gear 20, a sun gear 22 and a carrier assembly 24. The generator 16 is driven by the power transfer unit 18 when acting as a generator to convert kinetic energy to electrical energy. The generator 16 can alternatively function as a motor to convert electrical energy into kinetic energy, thereby outputting torque to a shaft 26 connected to the carrier assembly 24 of the power transfer unit 18. Because the generator 16 is operatively connected to the engine 14, the speed of the engine 14 can be controlled by the generator 16.

The ring gear 20 of the power transfer unit 18 may be connected to a shaft 28 that is connected to vehicle drive wheels 30 through a second power transfer unit 32. The second power transfer unit 32 may include a gear set having a plurality of gears 34A, 34B, 34C, 34D, 34E, and 34F. Other power transfer units may also be suitable. The gears 34A-34F transfer torque from the engine 14 to a differential 38 to provide traction to the vehicle drive wheels 30. The differential 38 may include a plurality of gears that enable the transfer of torque to the vehicle drive wheels 30. The second power transfer unit 32 is mechanically coupled to an axle 40 through the differential 38 to distribute torque to the vehicle drive wheels 30.

The motor 36 can also be employed to drive the vehicle drive wheels 30 by outputting torque to a shaft 46 that is also connected to the second power transfer unit 32. In one embodiment, the motor 36 and the generator 16 are part of a regenerative braking system in which both the motor 36 and the generator 16 can be employed as motors to output torque. For example, the motor 36 and the generator 16 can each output electrical power to a high voltage bus 48 and the energy storage device 50. The energy storage device 50 may be a high voltage battery that is capable of outputting electrical power to operate the motor 36 and the generator 16. Other types of energy storage devices and/or output devices can also be incorporated for use with the electrified vehicle 12.

The motor 36, the generator 16, the power transfer unit 18, and the power transfer unit 32 may generally be referred to as a transaxle 42, or transmission, of the electrified vehicle 12. Thus, when a driver selects a particular shift position, the transaxle 42 is appropriately controlled to provide the corresponding gear for advancing the electrified vehicle 12 by providing traction to the vehicle drive wheels 30.

The powertrain 10 may additionally include a control system 44 for monitoring and/or controlling various aspects of the electrified vehicle 12. For example, the control system 44 may communicate with the electric drive system 25, the power transfer units 18, 32 or other components to monitor and/or control the electrified vehicle 12. The control system 44 includes electronics and/or software to perform the necessary control functions for operating the electrified vehicle 12. In one embodiment, the control system 44 is a combination vehicle system controller and powertrain control module (VSC/PCM). Although it is shown as a single hardware device, the control system 44 may include multiple controllers in the form of multiple hardware devices, or multiple software controllers within one or more hardware devices.

A controller area network (CAN) 52 allows the control system 44 to communicate with the transaxle 42. For example, the control system 44 may receive signals from the transaxle 42 to indicate whether a transition between shift positions is occurring. The control system 44 may also communicate with a battery control module of the energy storage device 50, or other control devices.

Additionally, the electric drive system 25 may include one or more controllers 54, such as an inverter system controller (ISC). The controller 54 is configured to control specific components within the transaxle 42, such as the generator 16 and/or the motor 36, such as for supporting bidirectional power flow. In one embodiment, the controller 54 is an inverter system controller combined with a variable voltage converter (ISC/VVC).

The electrified vehicle 12 may also be equipped with one or more additional power sources in addition to the energy storage device 50. For example, the electrified vehicle 12 may include a fuel cell system 55 and/or an ultra cap system 57 for powering various vehicle loads. In one embodiment, the fuel cell system 55 and the ultra cap system 57 are provided as parallel power sources to the energy storage device 50. It should be appreciated that the electrified vehicle 12 could be equipped with any combination of power sources.

The energy storage device 50 may include one or more contactors 60 for selectively opening and closing the connection between the energy storage device 50 and the electric machine 16, 36 or other loads of the electrified vehicle 12 over the high voltage bus 48. In one embodiment, the contactor 60 acts as a high voltage relay for electronically switching a supply current to various loads of the electrified vehicle 12. For example, the contactor 60 may couple or decouple the high voltage power generated in the energy storage device 50 to/from the electric machines 16, 36.

When in a closed position, the contactor 60 couples the energy storage device 50 to the electric machine 16, 36 over the high voltage bus 48. Alternatively, when the contactor is in an open position, the energy storage device 50 is decoupled or isolated from the high voltage bus 48.

In one non-limiting embodiment, the energy storage device 50 may employ two contactors 60, one of which is a pre-charge contactor. The contactors 60 are both closed in response to a vehicle key on condition. After a predefined charge is reached, the pre-charge contactor opens during normal operation of the electrified vehicle 12. The other contactor opens to isolate the energy storage device 50 from the high voltage bus 48 in response to a vehicle key off condition.

In another non-limiting embodiment, at least one of the contactors 60 of the energy storage device 50 includes an integrated service disconnect unit that can be actuated to prepare the electrified vehicle 12 for a service procedure. One such integrated contactor/service disconnect assembly is described below and illustrated with respect to FIGS. 2, 3 and 4.

Figure 2:
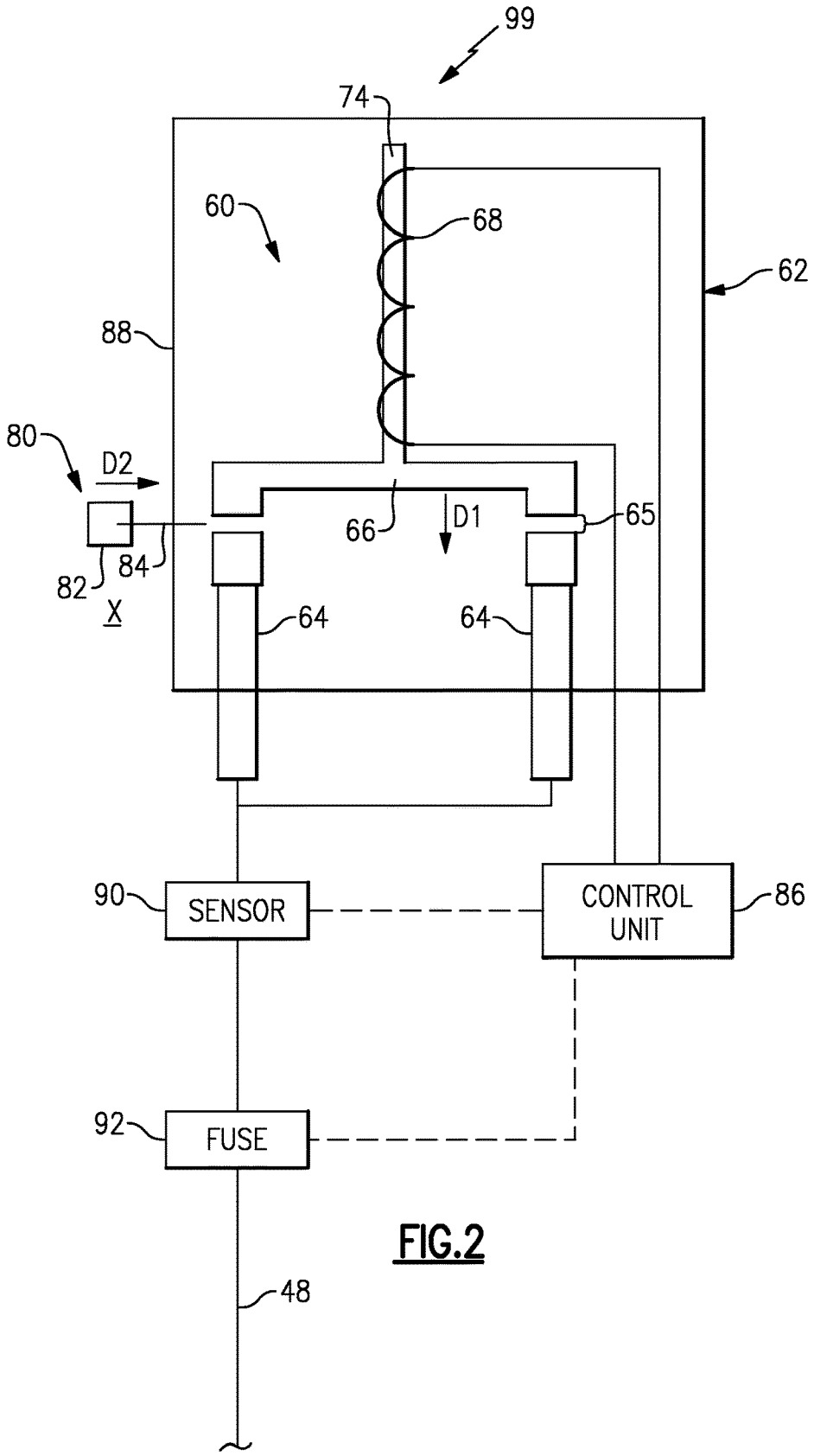
FIG. 2 illustrates an integrated contactor/service disconnect assembly that can be incorporated into an energy storage device of an electrified vehicle.

FIG. 2 illustrates an integrated contactor/service disconnect assembly 99 that may be employed within an energy storage device such as a battery assembly or the energy storage device 50 of the electrified vehicle 12 of FIG. 1. The integrated contactor/service disconnect assembly 99 includes a contactor 60 as well as a service disconnect unit 80 that is integrated with the contactor 60. In this disclosure, the term "integrated" means the contactor 60 and the service disconnect unit 80 are packaged in a single, combined unit rather than being located remotely from one another inside the energy storage device 50.

The contactor 60 of the integrated contactor/service disconnect assembly 99 includes a housing 62, at least one stationary contact 64 (two shown in FIG. 2), at least one movable contact 66 and a coil 68. The stationary contact 64, the movable contact 66 and the coil 68 are each housed inside of the housing 62.

In one embodiment, the stationary contacts 64 are high voltage pins. The stationary contacts 64 connect to the high voltage bus 48. In another embodiment, the movable contact 66 is configured as a busbar. These exemplary configurations are not intended to limit the scope of this disclosure.

The contactor 60 of the integrated contactor/service disconnect assembly 99 is depicted in an open position in FIG. 2. In the open position, the movable contact 66 is spaced from the stationary contact 64 such that a gap 65 extends therebetween. In such a position, the energy storage device 50 (see FIG. 1) is isolated from the high voltage bus 48. In other words, the energy storage device 50 is decoupled from its various loads when the contactor 60 is in the open position.

The movable contact 66 is carried by a shaft 74. The coil 68 is at least partially wrapped around the shaft 74. Energization of the coil 68 is controlled by a control unit 86 to control the movement of the shaft 74. For example, in order to close the contactor 60 of the integrated contactor/service disconnect assembly 99, the coil 68 is energized by a current to move the movable contact 66 in a direction D1 toward the stationary contacts 64. The contactor 60 may be closed in response to a vehicle on condition or any other condition. Once the contactor 60 is closed, high voltage current may flow through the stationary contacts 64 to the high voltage bus 48 for powering one or more loads (e.g., the motor 36, the controller 54, etc.) of the electrified vehicle 12.

In one embodiment, the service disconnect unit 80 includes a service button 82 and a prong 84 connected to the service button 82. The service disconnect unit 80 could be made of a single piece or could be constructed from multiple pieces. The prong 84 may extend inside of the housing 62. The service button 82 may be positioned relative to an exterior wall 88 of the housing 62 such that it is accessible by service technicians.

The service disconnect unit 80 is movable between a first position X (see FIG. 2) and a second position X' (see FIG. 3) to prevent the movable contact 66 from contacting the stationary contacts 64. In one embodiment, the service button 82 may be actuated in a direction D2, such as by pressing, to move the prong 84 to a position between the movable contact 66 and the stationary contact 64. The direction D2 is a different direction from the direction D1. In one non-limiting embodiment, the direction D2 is perpendicular to the direction D1.

Figure 3:
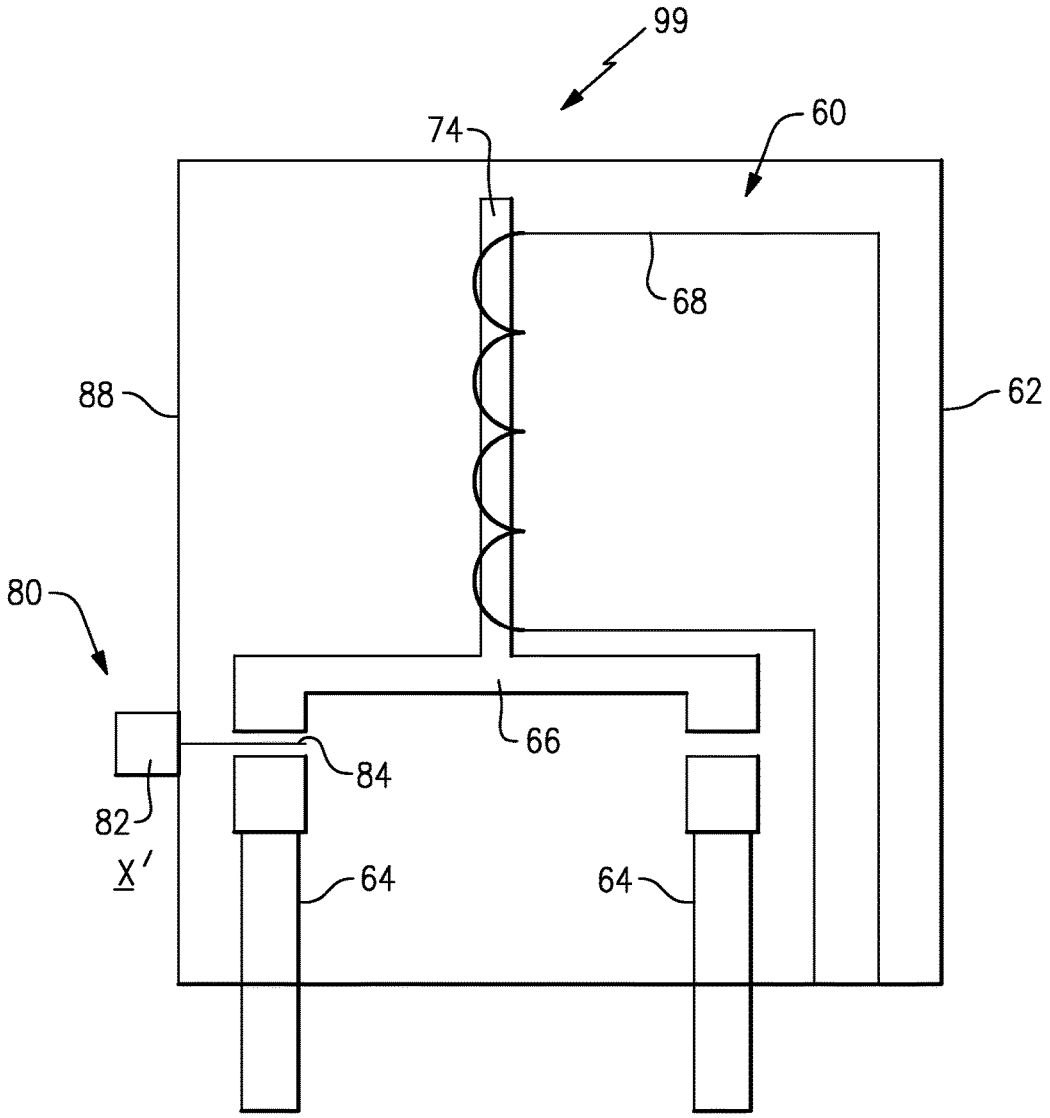
FIG. 3 illustrates a service disconnect position of an integrated contactor/service disconnect assembly.

Once moved to the second position X' shown in FIG. 3, the service disconnect unit 80 blocks the movable contact 66 from contacting the stationary contact 64, thereby preventing the flow of high voltage current through the integrated contactor/service disconnect assembly 99 to the high voltage bus 48. In one embodiment, the service button 82 directly abuts the exterior wall 88 of the housing 62 in the second position X'. The electrified vehicle 12 may be serviced once the service disconnect unit 80 is moved to the second position X' shown in FIG. 3.

The integrated contactor/service disconnect assembly 99 may additionally include a sensor 90 and a fuse 92 as part of a battery protection circuit. The sensor 90 is configured to sense a voltage of the current flowing from the stationary contacts 64 of the contactor 60. The sensed information is communicated to the control unit 86. The control unit 86 may be programmed to perform one or more operations related to the integrated contactor/service disconnect assembly 99. In one non-limiting embodiment, the control unit 86 may command energization/de-energization of the coil 68 for opening/closing the contactor 60 based on the information it receives from the sensor 90.

The fuse 92 may selectively interrupt the circuit to prevent high voltage current from being transferred to the high voltage bus 48. For example, the fuse 92 may provide short circuit protection in situations where the sensor 90 senses battery overload conditions.

Figure 4:
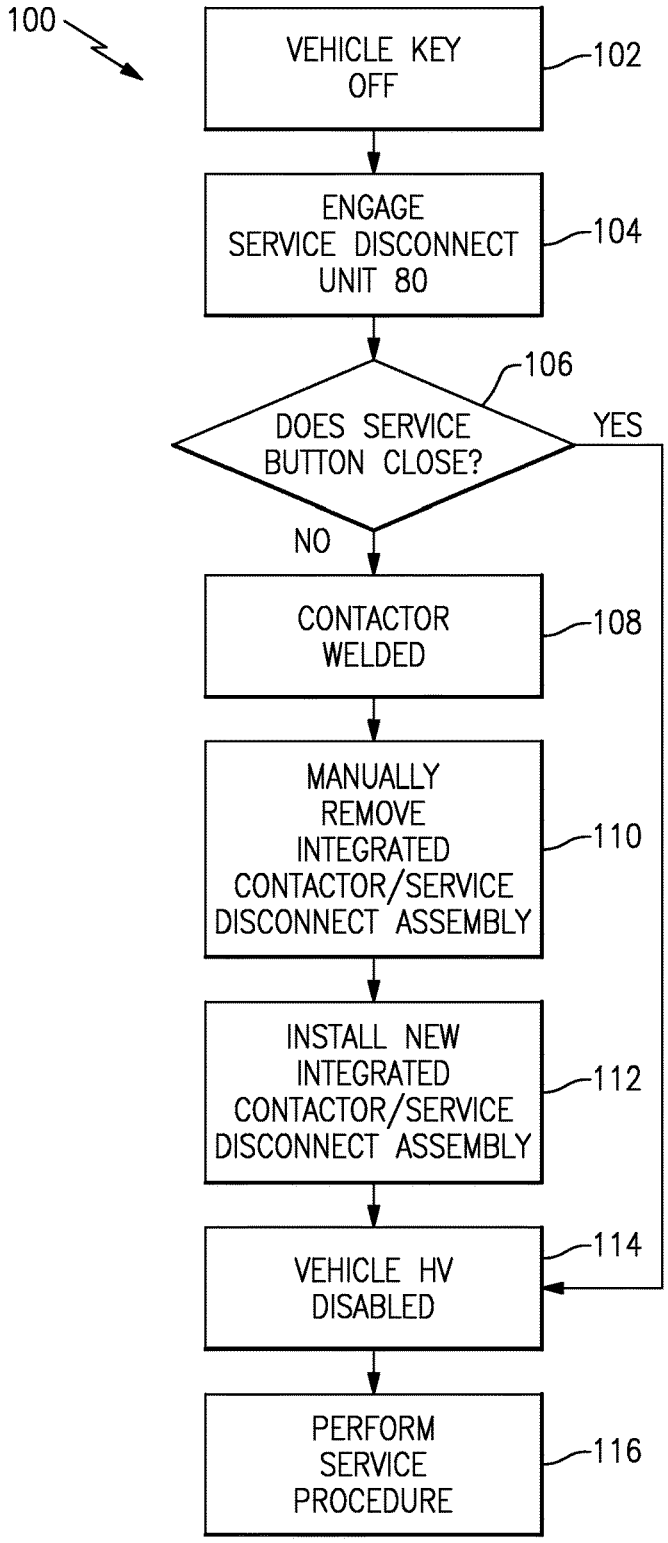
FIG. 4 schematically illustrates a vehicle service method.

FIG. 4, with continued reference to FIGS. 1, 2 and 3, schematically illustrates a vehicle service method 100 for servicing high voltage components of an electrified vehicle. For example, the method 100 may be performed in order to service the energy storage device 50, the controller 54, the motor 36 or any other component of the electrified vehicle 12. The method 100 may be performed by a service technician or some other authorized individual.

The method 100 begins in response to a vehicle key off condition, shown schematically at block 102. Next, at block 104, a technician may engage a service disconnect unit 80 of an integrated contactor/service disconnect assembly 99. It can then be determined whether the service button 82 of the service disconnect unit 80 closes at block 106. In one embodiment, block 106 includes pressing the service button 82 to attempt to position the prong 84 between the movable contact 66 and the stationary contact 64 of the contactor 60.

If the service button 82 of the service disconnect unit 80 is movable at block 106 to the second position X' such as shown in FIG. 3, the vehicle high voltage is disabled at block 114. However, if the service button 82 will not close, this indicates that the stationary and movable contacts 64, 66 of the contactor 60 have likely welded together (see block 108).

If it is determined that the contactor 60 has welded shut at blocks 106 and 108, the integrated contactor/service disconnect assembly 99 is manually removed at block 110 and is replaced at block 112 with a new integrated contactor/service disconnect assembly 99. The method 100 may then proceed to block 114 by disabling the vehicle high voltage current. In one embodiment, the vehicle high voltage current is disabled by moving the service disconnect unit 80 from the first position X to the second position X' (see FIGS. 2 and 3). The movable contact 66 is prevented from contacting the stationary contact 64 when the service disconnect unit 80 is moved to the second position X'.

Finally, at block 116, the technician may perform a desired service procedure on the electrified vehicle 12. The method 100 can be performed by a service technician each time a service procedure is required on an electrified vehicle.

Although the different non-limiting embodiments are illustrated as having specific components or steps, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. An integrated contactor/service disconnect assembly, comprising:

a stationary contact;

a movable contact selectively movable relative to said stationary contact; and a service disconnect unit configured to block said movable contact from contacting said stationary contact;

wherein said service disconnect unit includes a service button and a prong that extends from said service button; and wherein said prong is movable to a position between said stationary contact and said movable contact.

2. The assembly as recited in claim 1, wherein said stationary contact is a high voltage pin.

3. The assembly as recited in claim 1, wherein said movable contact is a busbar carried by a shaft.

4. The assembly as recited in claim 3, comprising a coil at least partially wrapped around said shaft.

5. The assembly as recited in claim 1, wherein said service disconnect unit is moveable between a first position in which said stationary contact and said movable contact may contact one another and a second position in which said stationary contact and said movable contact are prevented from contacting one another.

6. The assembly as recited in claim 1, wherein said service disconnect unit is movable in a first direction and said movable contact is movable in a second, different direction.

7. The assembly as recited in claim 1, comprising a control unit configured to command movement of said movable contact toward said stationary contact.

8. The assembly as recited in claim 1, comprising a sensor configured to sense a current through said stationary contact and a fuse configured to interrupt the flow of said current.

9. An energy storage device, comprising:

a contactor; and a service disconnect unit integrated with said contactor, said service disconnect unit including a prong moveable to a position between two contacts of said contactor to disable high voltage current through said contactor;

wherein said energy storage device is a high voltage battery for an electrified vehicle.

10. The energy storage device as recited in claim 9, wherein said contactor includes a movable contact and a stationary contact, and said service disconnect unit is moveable between a first position and a second position to prevent contact between said movable contact and said stationary contact.

11. The energy storage device as recited in claim 9, wherein said service disconnect unit includes a service button positioned relative to an exterior wall of a housing of said contactor and said prong extends inside of said housing.

12. The energy storage device as recited in claim 9, comprising a control unit configured to energize a coil of said contactor.

13. The energy storage device as recited in claim 12, wherein said contactor includes a movable contact and a stationary contact, said moveable contact carried by a shaft, said coil wrapped around said shaft, and once energized, said shaft moves to move said movable contact toward said stationary contact.

14. An energy storage device, comprising:

a contactor; and a service disconnect unit integrated with said contactor, said service disconnect unit including a prong moveable to a position between two contacts of said contactor to disable high voltage current through said contactor;

wherein said contactor and said service disconnect unit are packaged in a single, combined unit.

15. A high voltage battery assembly for an electrified vehicle, comprising:

a first contactor;

a second contactor; at least one of said first contactor and said second contactor including a service disconnect unit comprising:

a service button; and a prong connected to said service button and moveable between a first position, which is not between contacts of said first contactor or said second contactor, and a second position, which is between said contacts.

16. The high voltage battery assembly as recited in claim 15, wherein one of said first contactor and said second contactor is a pre-charge contactor.

* * * * *